United States Patent [19]

Jett, Jr.

[11] 4,319,179

[45] Mar. 9, 1982

[54] VOLTAGE REGULATOR CIRCUITRY HAVING LOW QUIESCENT CURRENT DRAIN AND HIGH LINE VOLTAGE WITHSTANDING CAPABILITY

[75] Inventor: William B. Jett, Jr., San Jose, CA

[73] Assignee: Motorola, Inc., Schaumburg, Ill.

[21] Appl. No.: 181,304

[22] Filed: Aug. 25, 1980

[51] Int. Cl.[3] ..... G05F 1/58

[52] U.S. Cl. ..... 323/281; 361/18

[58] Field of Search ..... 323/265, 269, 273, 274, 323/275, 276, 281; 361/18; 330/252, 261, 207 P

[56] References Cited

U.S. PATENT DOCUMENTS 3,671,770 6/1972 Frederiksen ..... 323/281

3,939,399 2/1976 Fanatsu et al. ..... 323/275

FOREIGN PATENT DOCUMENTS 447696 7/1975 U.S.S.R. ..... 323/281

*Primary Examiner*—William H. Beha, Jr.

*Attorney, Agent, or Firm*—Maurice J. Jones, Jr.

[57] ABSTRACT

The voltage regulator circuit includes a Darlington pass device, a feedback circuit and an error amplifier connected between the feedback circuit and the Darlington pass device. The error amplifier is arranged to conduct a current which is proportional to the control current of the pass device so that under standby conditions when the control current of the pass device has a low magnitude the power dissipation of the voltage regulator is minimized. A high voltage sustaining transistor, which is connected between the pass device and the error amplifier, is arranged to have a high voltage sustaining capability.

13 Claims, 2 Drawing Figures

VOLTAGE REGULATOR CIRCUITRY HAVING LOW QUIESCENT CURRENT DRAIN AND HIGH LINE VOLTAGE WITHSTANDING CAPABILITY

BACKGROUND OF THE INVENTION

Modern-day electronic systems often require voltage regulators which receive an unregulated line voltage and provide a regulated power supply voltage to an electrical load. Such voltage regulators are required to provide a supply voltage having a relatively constant magnitude to the electrical load even though the resistance of the electrical load changes and even though the magnitude of the line voltage changes. The magnitude of the regulated output voltage is less than or equal to the lowest magnitude of the line voltage and greater than the magnitude of a fixed reference voltage which can be provided by a zener diode, a Brokaw, or a bandgap reference.

More particularly a common configuration of a prior art series voltage regulator includes PNP Darlington pass transistors having a composite emitter electrode connected to the line voltage and collector electrodes connected to the regulator output terminal. A differential error amplifier includes one transistor having a collector connected to the composite base of the Darlington transistors and a base electrode connected to the voltage reference supply. Another differential transistor having a collector connected to the regulator output terminal is also included in the error amplifier. A bias supply current source is connected between the line voltage terminal and the collector electrode of the first mentioned differential amplifier transistor. A differential amplifier current sink or supply is connected to the emitters of the differential transistors.

Unfortunately, PNP Darlington transistors commonly used in monolithic integrated circuits for regulating a positive voltage supply have low betas. Consequently, the current sink for the differential error amplifier is required to draw or sink a current having an undesirably large magnitude under quiescent or no load conditions so that a desired amount of drive can be provided to the Darlington under full load conditions. Quiescent current also must be conducted by the bias current supply to facilitate high frequency response. This large quiescent current is disadvantageous in at least two respects. Firstly, the quiescent current drain wastes energy and, secondly, the large quiescent current must be dissipated by the regulator thereby undesirably heating the die.

Another problem with the foregoing standard prior art series voltage regulator relates to voltage breakdown. More specifically, the magnitude of the line potential minus the voltage drop across the emitter-to-base junctions of the Darlington is present at the collector electrode of the first mentioned differential transistor. Furthermore, the reference voltage, which for the Brokaw or bandgap reference generators is approximately 1.2 volts, is applied to the base electrode of the same differential error amplifier transistor. Accordingly, the magnitude collector-to-base voltage on the differential transistor is approximately equal to the magnitude of the input line voltage minus only a few volts. In automotive applications, the line or battery voltage supplied by the automobile may be as much as 50 volts during a "load dump" condition, which occurs when one of the battery cables is lifted while the electrical system is supplying a current having a large magnitude. Thus, the differential transistor is required to withstand collector-to-base voltages of at least 50 volts. Such transistors are difficult to fabricate by known $I^2L$ compatible processes in a monolithic integrated circuit when connected in the prior art configuration. $I^2L$ processes are commonly used for fabricating circuitry used in automotive applications.

SUMMARY OF THE INVENTION

One object of the invention is to provide voltage regulators which dissipate a minimum amount of power under standby conditions.

Another object of the invention is to provide voltage regulators which can withstand relatively high line voltages.

A further object of the invention is to provide simple voltage regulators suitable for being fabricated in monolithic integrated circuit form for use in automotive electrical systems.

Briefly, one embodiment of a regulator circuit in accordance with the invention provides an output signal having a regulated magnitude at an output terminal thereof in response to an input signal having an unregulated magnitude at an input terminal thereof. The regulator circuit includes an output electron control device and an error amplifier including first and second branches. The first branch includes a comparator device having a main electrode coupled to the output electron control device, a control electrode coupled to receive a reference potential and another main electrode directly connected to an additional reference potential conductor. The second branch includes a second comparator device having a main electrode coupled to the output electron control device, a control electrode adapted to receive a feedback signal representative of the magnitude of the output signal and another main electrode directly connected to the additional reference potential conductor.

The first and second comparator devices are responsive to the relative magnitudes of the feedback signal and the second reference potential to control the output electron control device for providing regulation of the magnitude of the output signal. By directly connecting the main electrodes of the comparator devices to a reference potential, it is possible for these devices to collectively conduct a current which is proportional to the instantaneous control current of the output electron control device thereby lowering power dissipation of the regulator under standby conditions. Also, a high voltage sustaining device is inserted between the error amplifier and the output electron control device.

DETAILED DESCRIPTION OF THE PREFERRED EMBODIMENT

Prior Art

Figure 1:
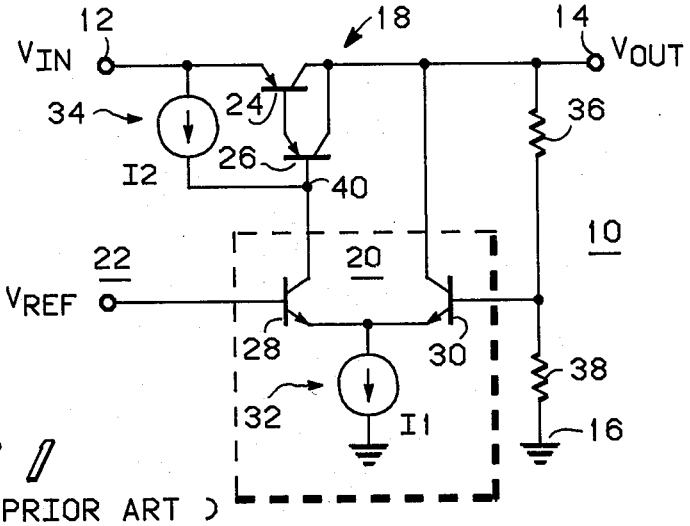
FIG 1 ( PRIOR ART )
FIG. 1 is a partial block and partial schematic drawing of a prior art series pass voltage regulator circuit.

FIG. 1 is a schematic diagram of a prior art series pass voltage regulator 10 which has been found suitable for many applications, but which has serious disadvantages with respect to power dissipation and voltage breakdown especially when provided in monolithic form. Voltage regulator 10 has an input terminal 12 to which an unregulated or line voltage is applied and an output terminal 14 at which a regulated voltage having a relatively constant magnitude as compared to the line voltage is to be developed. A variable electrical load requiring a regulated voltage is generally connected between terminal 14 and a ground terminal or conductor 16. Generally, regulator 10 includes a series pass device 18, an error amplifier 20, and a voltage reference supply (not shown) which is connected to terminal 22. The series pass device 18 includes Darlington connected PNP transistors 24 and 26. The error amplifier includes differentially connected NPN transistors 28, 30, and a current source or sink 32. Bias current supply 34 is connected between input terminal 12 and the collector electrode of transistor 28. A feedback voltage divider includes resistor 36 connected between output supply terminal 14 and the base electrode of transistor 30 and another resistor 38 connected between the base electrode of transistor 30 and ground or reference conductor 16.

Voltage regulator 10 is required to keep the magnitude of the voltage at terminal 14 constant even though the value of the resistance of the electrical load connected thereto changes and even though the magnitude of the input voltage at terminal 12 changes. By way of illustration, assume that the resistance of an electrical load connected to terminal 14 is decreased. As a result, the magnitude of the voltage at output terminal 14 would tend to undesirably decrease. This decrease in voltage would provide a decreased voltage across the voltage divider and at the base electrode of transistor 30. As a result of transistor 30 being less conductive, transistor 28 would become relatively more conductive thereby conducting more base current from the Darlington pass device 18. As a result, more current would be provided through output terminal 14 to the electrical load which regulates the output voltage to the desired magnitude.

Darlington transistors 18 will conduct a maximum amount of current when the input voltage at terminal 12 is at a maximum and the value of the load resistance is at a minimum. Under these conditions, the base current going into node 40 will have a maximum magnitude. Error amplifier current sink 32 must be designed to constantly draw a current of constant magnitude which is greater than the magnitude of the maximum base current of Darlington transistor 18 plus the magnitude of the constant bias current supplied from current source 34. Current sink 32 must be designed to conduct or draw this amount of current even under standby conditions when no-load is connected to output terminal 14. If circuit 10 is provided in monolithic integrated circuit form by standard processes, PNP Darlington 18 necessarily has a rather low beta, on the order of 25. Accordingly, current sink 32 must constantly conduct a current having an undesirably large magnitude which tends to heat up the die in which voltage regulator 10 is fabricated and to waste energy. Such undesirable heating of the die is particularly disadvantageous when circuit 10 is utilized in the under the hood environment of an automobile.

If a battery cable is lifted off of an automotive battery, under heavy electrical load while the engine is running, the alternator produces an inductive shock on the electrical line of the automobile which may have a magnitude of about 50 volts. This is referred to as "load dump." Thus, if terminal 12 is connected to the automotive line, this voltage is dropped by the base-to-emitter junctions of transistors 24 and 26 and occurs at the collector electrode of transistor 28. Moreover, the voltage reference at the base electrode of transistor 28 may be of about 1.2 volts if generated by a Brokaw or bandgap generator. Thus, transistor 28 may be subjected to base-to-collector voltages of about approximately 45 volts. Standard NPN transistors made on usual monolithic integrated circuit, $I^2L$ compatible lines are not capable of withstanding such voltages while in conduction. The permanent failure of transistor 28 if used in an automotive module including other circuitry for instance, could result in an expensive repair.

Configuration of the Preferred Embodiment

Figure 2:
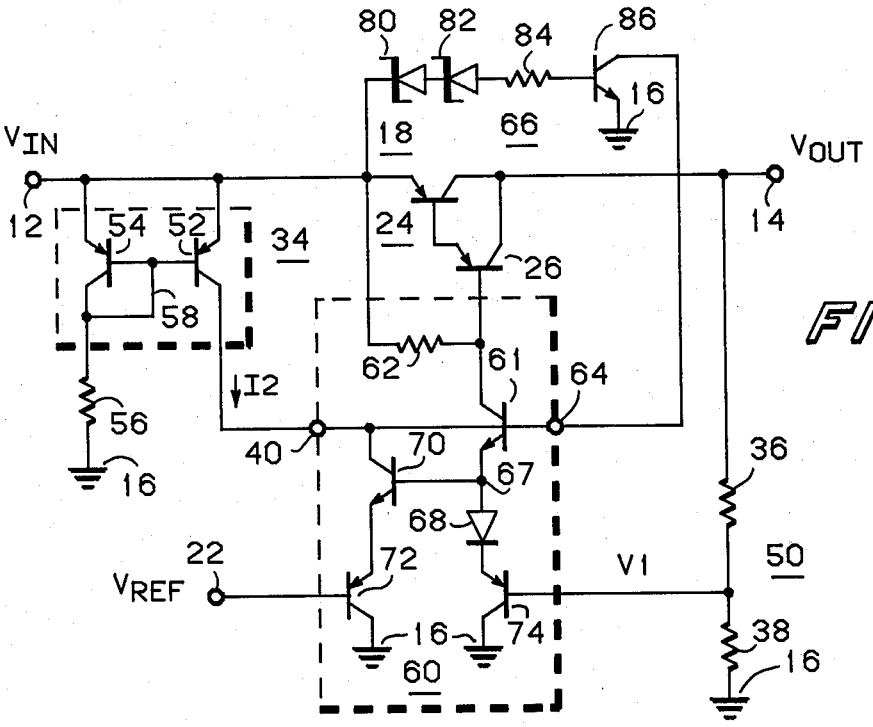
FIG. 2 is a partial block and schematic diagram of a series pass voltage regulator circuit constructed in accordance with the invention.

FIG. 2 is a circuit diagram of a series pass voltage regulator 50 which is arranged in accordance with the invention. As will be explained below, regulator 50 alleviates the power dissipation and voltage breakdown problems identified above with respect to regulator 10. The same reference numbers will be used in describing FIG. 2 as were used in explaining corresponding structure with respect to FIG. 1. The voltage regulator of FIG. 2 can be provided in either discrete or monolithic form.

Constant bias current source 34 is shown in FIG. 2 as including PNP transistor 52 and diode connected PNP transistor 54 having emitter electrodes connected to input or line voltage terminal 12, and commonly connected base electrodes. The collector electrode of transistor 54 is connected through resistor 56 to ground conductor 16 and through conductor 58 to the base electrode of transistor 56. The collector electrode of transistor 52, which provides the output current of current supply 34, is connected to bias terminal 40 of differential error amplifier 60. Current source 34 can, of course, be formed from other configurations and can be connected to other sources of voltage supply other than terminal 12. As in the configuration of FIG. 1, current source 34 is required to provide a constant current having a small magnitude for biasing the error amplifier.

Improved error amplifier 60 includes an NPN transistor 61 which is connected to have a relatively high collector-to-base breakdown voltage. The collector of transistor 61 is connected to the base electrode of PNP pass transistor 26 and through bias resistor 62 to voltage input terminal 12. The base electrode of transistor 61 is connected to control terminal 64 which may be left unconnected or connected to a threshold voltage sensitive control circuit 66, for example as shown in FIG. 2. The emitter electrode of transistor 61 is connected through circuit node 67 to the anode electrode of diode 68 and to the base electrode of NPN protection transistor 70. The collector electrode of transistor 70 is connected to terminal 40 and to the base electrode of transistor 61. NPN transistors 61 and 70 are connected in a cascode configuration.

PNP comparator transistor 72 includes an emitter electrode connected to the emitter electrode of transistor 70, a base electrode connected to receive the reference voltage at conductor 22, and a collector electrode connected to ground conductor 16. PNP comparator transistor 74 includes an emitter electrode connected to the cathode of diode 68, a base electrode connected to the feedback node between resistors 36 and 38 and a collector electrode connected to ground conductor 16. The base-to-emitter junction of transistor 70 and the collector-to-emitter path of transistor 72 form one parallel circuit path with diode 68 and the emitter-to-collector path of transistor 74 forming a second parallel circuit path. Transistors 72 and 74 form a differential amplifier which control device 18 to provide voltage regulation.

Quiescent Power Dissipation of Regulator 50

Under quiescent conditions, current supply 34 provides a bias current having a small magnitude on the order of 120 microamps to the base of transistor 61 which is thereby biased in its active region. A small emitter current on the order of 120 microamps is then provided by transistor 61 to node 67 which biases transistors 70 and 72, diode 68 and transistor 74. The total current conducted by regulator 50 during quiescent conditions is much less than the current being conducted by regulator 10 under similar conditions because error amplifier 60 is not required to conduct the maximum base currents of Darlington 18. As previously mentioned, the error amplifier of regulator 10 must conduct the maximum full-load base current required by Darlington 18 even under quiescent conditions. Therefore, the power dissipation of regulator 50 under no-load conditions is far less than the power dissipated by regulator 10 under similar conditions. Thus, regulator 50 neither heats up the integrated chip nor wastes as much energy as regulator 10 under similar quiescent conditions. Under quiescent conditions transistors 72 and 74 each conduct currents of around 120 microamps as compared to 2 milliamps conducted by current sink 32. Power dissipation is proportional to the square of the current.

Dynamic Conditions of Regulator 50

If the output voltage at terminal 14 of regulator 50 tends to decrease because of a decreased load resistance for instance, the magnitude of the voltage across voltage divider 36, 38 will decrease, thereby forcing the potential on the base of differential comparator transistor 74 closer to the reference potential on conductor 16 relative to transistor 72. Transistor 74 will thereby be rendered more conductive, thus lowering the voltage at the emitter of transistor 61. Therefore, transistor 61 will be rendered more conductive and draw an increased amount of base current from transistors 24 and 26. This enables Darlington 18 to supply more current to drive the voltage at terminal 14 up to the desired magnitude.

Furthermore, if the voltage at terminal 14 tries to undesirably increase because of an increased magnitude of the line voltage at terminal 12 for instance, the voltage at the base electrode of transistor 74 will be raised in a positive direction which tends to render transistor 74 less conductive relative to transistor 72. Consequently, transistor 61 will be rendered less conductive thereby reducing the base drive of Darlington 18 and consequently reducing the load current. As a result, the magnitude of the voltage at output terminal 14 will again be stabilized at the regulated value.

Breakdown Voltage of Regulator 50

If regulator 50 is used in an automotive environment wherein input terminal 12 is connected to the automotive line, it is possible for the magnitude of input voltage, Vin to double if a jump-start is being performed from the battery of another vehicle and even triple under load dump which happens, if one of the battery cables is lifted under load, as previously explained. Vref may have a low magnitude, e.g. of 1.2 volts and the voltage drop across the emitter-base junctions of transistors 24, 26, 61, 70, 72, 74 and diode 68 is only about 0.6 volts. Thus, most of the line voltage is developed across the collector-to-base junction of transistor 61.

An increasing voltage magnitude across the collector-to-base junction of transistor 61 tends to turn transistor 61 on irrespective of the amplitude of the output voltage at terminal 14. The leakage current across the collector-to-base junction of transistor 61 becomes beta multiplied by transistor 61 and provides a current through the emitter of transistor 61 which tends to render transistor 70 conductive. Transistor 70 then conducts the undesired leakage current from the base of transistor 61 through the collector of transistor 70. Consequently, transistor 61 is able to withstand much higher voltages across its collector-to-base junction without going into breakdown, than transistor 28, for example. Thus transistor 70 can protect high voltage withstanding transistor 61 under a jump start condition.

If the magnitude of the input voltage further increases, such as in response to a load dump condition for instance, zener diodes 80 and 82 which are connected in series with current limiting resistor 84 are rendered conductive. Consequently, NPN switching transistor 86 is rendered conductive thereby electrically connecting the base electrode of transistor 61 to ground conductor 16. The resulting short circuit of the base of transistor 61 through the series connected collector-emitter electrodes of transistor 86 forms a low impedance to ground for the base of transistor 61 which further raises the breakdown voltage of transistor 61 to near $V_{ces}$ which is the highest possible breakdown for transistor 61.

Thus, regulator 50 is able to sustain much higher line voltages than regulator 10 wherein the critical transistor 28 has its base electrode connected to a voltage reference supply which may not perform the required elimination of the undesired leakage current.

Conclusion

What has been described therefore is an improved voltage regulator circuit 50 having a simple configuration which requires only a relatively small amount of current during quiescent conditions and which is capable of sustaining relatively higher line voltage than prior art configurations, such as voltage regulator 10 for instance. The reduced quiescent current is facilitated by the error amplifier configuration 60 having increased conductivity only when it is necessary to conduct more current through Darlington 18 as compared to current source 32 of FIG. 1 which must conduct the maximum base current of the Darlington even during quiescent operation. The high voltage sustaining characteristic is facilitated by transistor 70 providing a low resistance path for the leakage current is transistor 61 during moderately high voltage operation and by transistor 86 providing an even lower resistance connection to ground for the base electrode transistor 61 during higher input voltage conditions. The circuitry of regulator 50 of FIG. 2 has been found to be advantageous in commercially successful integrated circuit products utilized in present day automotive engine control systems.

I claim:

1. A regulator circuit for providing an output signal having a regulated magnitude at an output terminal thereof in response to an input signal having an unregulated magnitude at an input terminal thereof, including in combination:

output electron control means having input, output and control terminals;

first circuit means electrically coupling said control terminal to a circuit node;

a first reference potential conductor for providing a first reference potential;

a second reference potential conductor for providing a second reference potential;

a first parallel circuit branch including first comparator electron control means having a main electrode coupled to said circuit node, a control electrode coupled to said second reference potential conductor, and another main electrode directly connected to said first reference potential conductor;

a second parallel circuit branch including second comparator electron control means having a main electrode coupled to said circuit node, a control electrode adapted to receive a feedback signal representative of the magnitude of the output signal, and another main electrode of said second comparator electron control device being directly connected to said first reference potential conductor; and said first and second comparator electron control means being responsive to the relative magnitudes of said feedback signal and said second reference potential to control said output electron control means for providing the regulation of the magnitude of the output signal.

2. The regulator circuit of claim 1 wherein:

said first and second comparator electron control means collectively conduct a current having a magnitude which is proportional to the magnitude of the control current of said output electron control means to facilitate low power dissipation in response to said control current for said output electron control means having a small magnitude.

3. The regulator circuit of claim 1 wherein said output electron control means and said first and second comparator electron control means each include transistor means of a first conductivity type.

4. The regulator circuit of claim 3 wherein said first circuit means includes third transistor means of a second conductivity type having main electrodes connected between said control electrode of said output electron control means and said circuit node, said third transistor means being arranged to have a high breakdown voltage sustaining capability.

5. The regulator circuit of claim 4 wherein said third transistor means has a collector electrode connected to said control electrode of said output electron control means, an emitter electrode and a base electrode; and a fourth transistor means of the second conductivity type having a base electrode connected to said emitter electrode of said third transistor means and a collector electrode connected to said base electrode of said third transistor means such that said fourth transistor means is rendered conductive by said emitter current of said third transistor means, said fourth transistor means thereby conducting base current from said third transistor means to enable said third transistor means to have said high breakdown voltage sustaining capability.

6. The regulator circuit of claim 5 further including diode means connected between said emitter electrode of said third transistor means and said second comparator electron control device.

7. The regulator circuit of claim 5 further including bias current supply means connected to said collector electrode of said fourth transistor means and to said base electrode of said third transistor means.

8. The regulator circuit of claim 5 further including threshold sensitive means coupled between the input terminal of the regulator and said base electrode of said third transistor means and said first reference potential conductor, said threshold sensitive means being responsive to the magnitude of the regulator input signal exceeding a predetermined level to electrically connect said base electrode of said third transistor means to said first reference potential conductor to increase said breakdown voltage sustaining capability of said third transistor means.

9. The regulator circuit of claim 8 wherein said threshold sensitive means includes in combination:

zener diode means coupled to the input terminal of the regulator, switching transistor means having a base electrode coupled to said zener diode means, an emitter electrode coupled to said first reference potential conductor, and a collector electrode connected to said base electrode of said third transistor means.

10. A voltage regulator circuit for providing an output voltage having a regulated magnitude at an output terminal thereof in response to an input voltage having an unregulated magnitude at an input terminal thereof, including in combination:

output transistor means of a first conductivity type having input, output, and control terminals;

first circuit means electrically coupling said control terminal to a circuit node;

first reference potential conductor for conducting a first reference potential;

second reference potential conductor for conducting a second reference potential;

first parallel circuit branch including a first comparator transistor means of said first conductivity type having a main electrode coupled to said circuit node, a control electrode coupled to said second reference potential conductor, and another main electrode directly connected to said first reference potential conductor;

second parallel circuit branch including second comparator transistor means having a main electrode coupled to said circuit node, a control electrode adapted to receive a feedback signal having a magnitude representative of the magnitude of the regulator output voltage, and another main electrode of said second comparator transistor means being directly connected to said first reference potential conductor, said first and second comparator transistor means conducting currents having magnitudes proportional to the magnitude of the control current of said output transistor means to facilitate low power dissipation when said control current of said output transistor means has a small magnitude; and said first and second comparator transistor means being responsive to the relative magnitudes of said regulator output voltage and said second reference voltage to control said output transistor means for providing regulation of the magnitude of the output voltage.

11. The voltage regulator circuit of claim 10 wherein said first circuit means includes:

third transistor means of the second conductivity type having a collector electrode connected to said control terminal of said output transistor means, an emitter electrode and a base electrode; and fourth transistor means of said second conductivity type having a base electrode connected to said emitter electrode of said third transistor, means, and a collector electrode connected to said base electrode of said third transistor means such that said fourth transistor means is rendered conductive by said emitter current of said third transistor means, said fourth transistor means thereby conducting base current from said third transistor means to enable said third transistor means to have a high voltage sustaining capability.

12. The voltage regulator circuit of claim 11 wherein said emitter electrode of said fourth transistor means is connected to a main electrode of said first comparator transistor means.

13. The voltage regulator circuit of claim 11 further including diode means connected between said emitter electrode of said third transistor means and a main electrode of said second comparator transistor means.

* * * * *